US007513205B2

(12) United States Patent
Morris, III et al.

(10) Patent No.: US 7,513,205 B2
(45) Date of Patent: Apr. 7, 2009

(54) MOVABLE BALLAST IN A SAILING VESSEL

(75) Inventors: Matthew G. Morris, III, San Diego, CA (US); Matthew G. Morris, Jr., San Diego, CA (US)

(73) Assignee: Matthew G. Morris, San Diego, CA (US)

( * ) Notice: Subject to any disclaimer, the term of this patent is extended or adjusted under 35 U.S.C. 154(b) by 0 days.

(21) Appl. No.: 11/804,869

(22) Filed: May 21, 2007

(65) Prior Publication Data

US 2008/0289555 A1 Nov. 27, 2008

(51) Int. Cl.
*B63B 35/00* (2006.01)

(52) U.S. Cl. ..... 114/140; 114/124

(58) Field of Classification Search ..... 114/124, 114/127–143

See application file for complete search history.

(56) References Cited

U.S. PATENT DOCUMENTS 23,114 A * 3/1859 Pratt ..... 114/136
4,044,703 A * 8/1977 Kurtz ..... 114/143
4,817,550 A * 4/1989 Gutsche ..... 114/124
5,152,238 A * 10/1992 Page ..... 114/143
5,163,377 A 11/1992 Calderon et al.
5,622,130 A 4/1997 Calderon et al.
6,886,481 B1 5/2005 Lord
7,128,010 B2 10/2006 Robinson et al.

* cited by examiner

*Primary Examiner*—Ed Swinehart

(57) ABSTRACT

An external adjustable ballast system for keeled sailboats comprising a weight that is designed for low hydrodynamic drag, mounted through a beam to a shaft running down the leading edge of the fin keel. Turning the shaft moves the weight to optimize hull trim, both fore/aft and athwartships, for a particular point of sail. If the weight and beam are shaped as a lifting body and mounted to the shaft such that it pivots as it rotates to optimize angle of attack, the dynamic balancing component can allow for a lighter weight. Ballast weight and beam can be raised or lowered to optimize performance for expected wind conditions. The leading edge of the fin keel is a rotatable non spherical shaft. When rotated, the shaft creates an asymmetric cross section which improves hydrodynamic efficiency of the keel.

9 Claims, 5 Drawing Sheets

MOVABLE BALLAST IN A SAILING VESSEL

BACKGROUND OF THE INVENTION

1. Technical Field

This invention relates generally to sailing yachts, and more particularly to externally ballasted high performance sailing yachts.

2. Description of Related Art

Typically, external ballast is located at the lowest point on rigidly fixed keels. The keel serves two functions—it supports the external ballast and it provides a high aspect lifting surface to keep the vessel from sliding sideways as it sails upwind. As the vessel heels, the ballast works to counteract the force of the wind. There is no restoring force until some angle of heel is generated. As vessels heel, the effective area of the lifting surface reduces, comprising the windward performance. Attempts to reduce the angle of heel, center on moving ballast. Two typical methods of moving ballast to the windward side of the vessel include the swing keel and internal water ballast. The swing keel mounts ballast on the bottom of the keel, using the keel as a moment arm to increase the effectiveness of the weight in generating a righting moment. Water ballast using pumps to fill bladders inside the hull as needed to adjust trim. Since the water is inside the hull the moment arm to the center of buoyancy is short, requiring significantly more weight to an equivalent righting moment.

U.S. Pat. Nos. 5,163,377 and 5,622,130 describe various aspects of a keel-less sailing yacht that has fore and aft cambered foils for leeway control and a dynamic gravitational ballast for heeling resistance. A ballast-supporting structure, in the form of an elongated strut extending downwardly from the hull, supports the ballast generally beneath the hull. Twin fore and aft rotatable foils are also supported by the hull with extension below the hull for optimum performance under a wide range of operating conditions, preferably being controlled by a hydraulic or electric system.

A keel-less sailing yacht with appendages in the form of a movable ballast-supporting strut and twin fore and aft foils is sometimes referred to as a canting ballast twin foil (CBTF) sailing yacht. Such CBTF sailing yachts enjoy recognized sailing success accompanied by significant interest in CBTF technology. However, various structural and operational concerns need attention.

For example, the downwardly depending foils and ballast-supporting strut hinder operations in shallower water. In addition, replacement of foils damaged by vessel grounding is impaired. Furthermore, operating performance of larger sailing yachts, including those designed for ocean racing or cruising, can suffer somewhat under various sailing conditions (e.g., sailing off wind) due to the friction drag introduced by the downwardly depending appendages. Thus, a need exists for CBTF improvements in these respects.

U.S. Pat. No. 6,886,481 describes a pivotable deployable bulb mounted foil apparatus for a sailboat whose foils can be deployed from a nested position and pivoted when needed for lateral resistance. This invention is especially adapted to a canting keel where the sailboat loses its lateral resistance from the keel when the keel is canted.

SUMMARY OF THE INVENTION

Attempts to reduce the angle of heel center on moving ballast. Two typical methods of moving ballast to the windward side of the vessel include: the swing keel and internal water ballast. This invention differs from prior art in several ways. The examples cited above either add weight, increases drag, or reduces the effective area of the lifting surface of the keel. This invention maintains the vertical orientation of the keel to the hull as a lifting surface and does not add weight to the vessel to increase the righting moment.

Water ballast systems require pumps and a water source to pump water from one side of the hull to the other to increase the righting moment and decrease the angle of heel. Since the effectiveness of ballast is proportional to the distance of the ballast from the centerline of the vessel, and since water ballast by definition must be contained within bladders or tanks mounted inside the ship's hull, significantly more water weight is needed to generate the same amount of righting moment as ballast suspended from the ship's keel. Mounting water ballast tanks and associated plumbing in a ship uses significant space and the additional weight affects sailing performance in several ways. The additional weight increases the wetted area of the hull (the boat rides deeper than it would with less weight), increasing drag and reducing performance. Shifting large quantities of water requires complex plumbing and mechanical equipment, and can include sensors and controls. Failures in any of these components can reduce the ships ability to move water to the appropriate location, affecting the sailing performance and possibly affecting the safety of the vessel.

Another method of increasing the righting moment is to mount ballast on the bottom of the ship's keel and hinge the keel on an axis longitudinal to the vessel centerline. This approach is commonly called a "swing keel" as the keel can be "swung" outward to lifts the ballast and therefore reduce the angle of heel. Because of the cost and complexity of this approach, most vessels employing this design are built for sailing competition. The swing keel approach adds no additional ballast weight, but swinging the keel away from the centerline of the boat has several adverse affects. First, swinging the keel away from a perpendicular presentation reduces the aspect of the keel, allowing more leeway when sailing upwind. Since this approach requires that the ballast be raised as it is swung to one side, hydraulics are often employed to perform this work. The structure of the hull therefore, must be designed to mount the keel hinge and control hydraulics and react the substantial forces generated when the ballast is lifted. Allowing the keel to swing outwards requires that the hull also have a large opening for the keel to mount with sufficient space for it to move to the full extent of its travel. This opening, through which the keel is mounted, is sealed with a flexible membrane. This seal requires routine inspection and maintenance, requiring the boat to be regularly dry docked. In addition, if any component in the system fails, the vessel would become unsafe and forced to retire from competition. The speed at which you can turn the vessel is extremely important in yacht racing and quite often important for the safe operation of cruising vessels. Even if a swing keel was not ballasted and weighed very little, viscous damping caused by lateral motion of high aspect, larger surface area, canting keels prevent vessel equipped with swing keels from tacking quickly.

FIG. 1 shows the overall concept of the rotating externally ballasted keel. The center of mass of a ballast weight 12 is located aft of a shaft 14 which supports the load and allows the ballast to rotate. The support beam 14 for the ballast weight is also a hydrodynamic surface which, when rotated, provides righting moment together with the offset weight of the ballast 12. The ballast 12 also moves forward as it swings. This serves to maintain fore/aft hull trim. The concept allows for a simpler, more effective and more reliable implementation as compared to prior art.

In the preferred embodiment, the ballast 12 is cantilevered from a rotating shaft 14, no technical work is done to move the ballast 12 (the ballast is not lifted—but rotated), decreasing structural loads and mechanism complexity. This approach eliminates the need for the complex hydraulics required for swing keels and allowing the device to be manipulated by hand in smaller vessels or by electric motor in larger vessels. Rotating seals on the shaft are much more reliable and easy to implement than sealing the hinged area between a swing keel and hull. In this approach, even if the seals failed, the opening in the hull for the shaft could be made above the waterline, which would not allow water to enter the vessel—even if the seal completely failed, a safer approach. This design also provides for a clean transition from the hull to the keel as compared to the flexible interface in a swing keel design, thereby avoiding the increase in drag associated with that flexible seal approach.

The shaft 14 is rotated by the crew from inside the vessel by using a lever arm attached to the shaft on smaller vessels or a gear head electric motor on larger vessels. The arm could be actuated manually or automatically much more quickly than hydraulic actuation of a canting keel. The position of the arm would also indicate the position of the ballast. The arm would be positioned approximately perpendicular to the boom. As the point of sail moved forward, the ballast would be rotated to offset the force generated by the pressure on the sail. This adjusts both the fore/aft and athwart ships hull trim. FIGS. 2 and 3 show the typical positions of the ballast for different points of sail. Typically, crew position ("live ballast") is moved to maintain fore/aft hull trim. This is done automatically as the ballast weight swings, it also moves fore and aft. The support shaft is angled back to cause the beam supporting the ballast to produce hydrodynamic lift to further increase the righting moment. The more the ballast is rotated, the more the angle of attack of the ballast beam would increase.

The following definitions are used herein to describe the hull geometry:

A centerline is a line lying in the vertical longitudinal plane cutting the hull down the middle from bow to stern.

Waterlines (or level lines) are defined as the intersection with the hull of waterplanes perpendicular to the hull centerplane, at various elevations.

Sections are defined as the intersection of a series of spaced vertical planes cutting the hull transversely to a centerline.

A midsection is one of the sections lying generally in the middle of the hull.

DETAILED DESCRIPTION OF THE PREFERRED EMBODIMENTS

Figure 1:
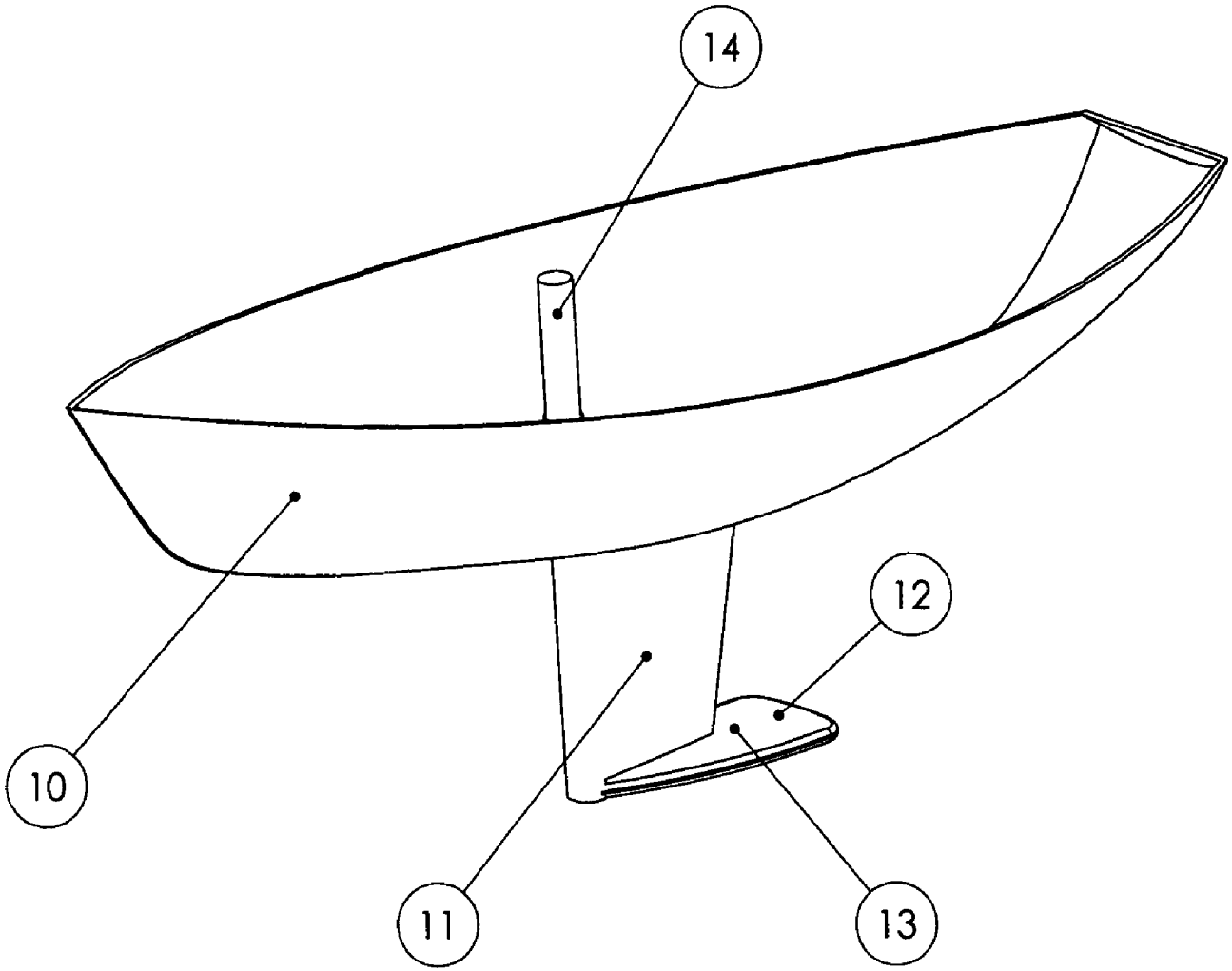
FIG. 1 is a perspective view of a rotate-able ballast system for a sailing yacht constructed in accordance with the present invention

FIG. 1 shows a typical hull 10 with fixed keel 11, support beam 13 and ballast 12. Said ballast 12 is mounted to shaft 14 which is mounted and supported in the forward portion of fixed keel 11. Rotating shaft 14 rotates the ballast 12 away from the centerline of the vessel. The connection and ballast support beam 13 on the bottom of said keel 11 can be arranged so that the center of mass of the ballast 12 moves forward and the support beam 13 angles down when shaft 14 is rotated.

Figure 2:
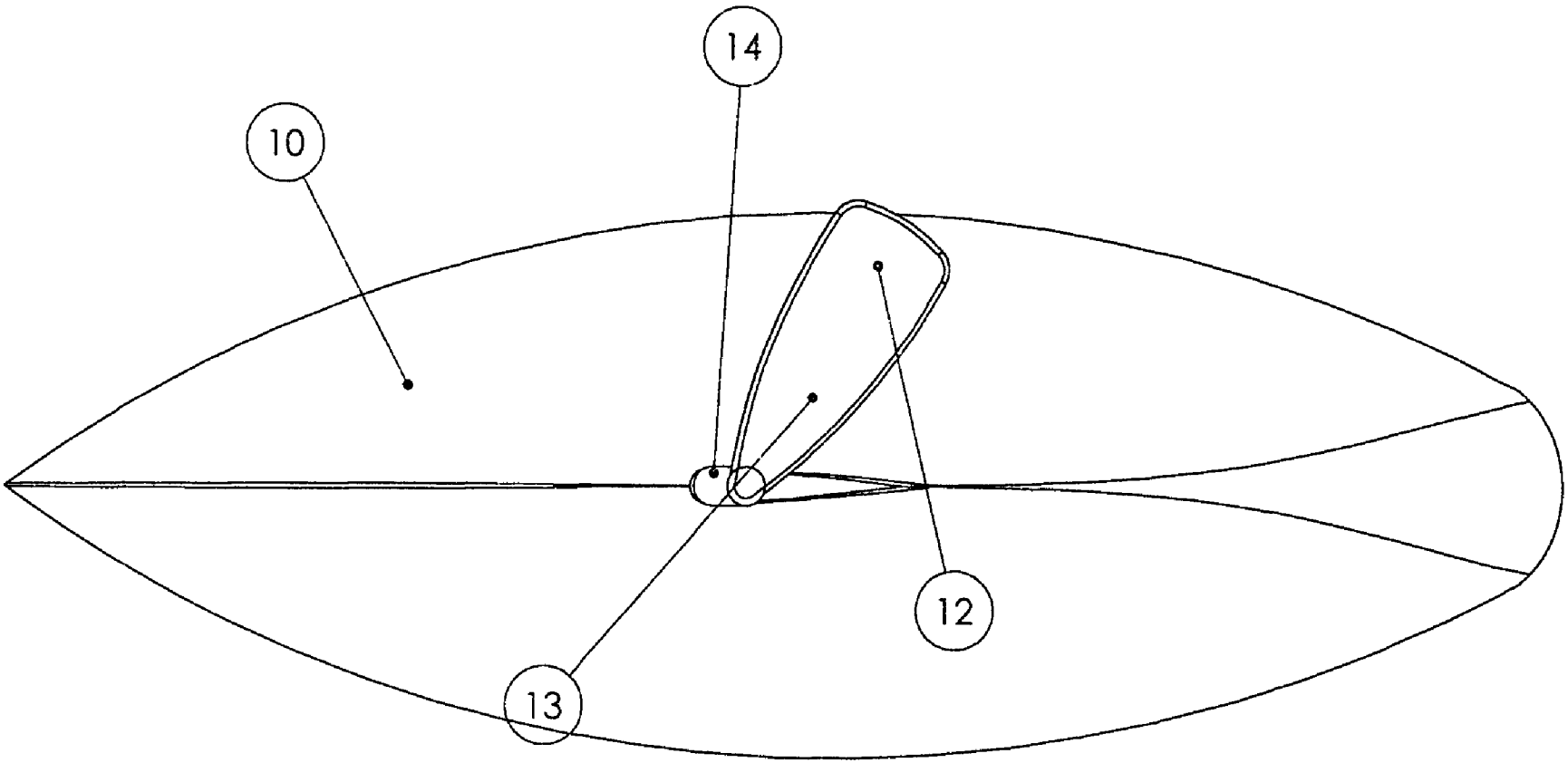
FIG. 2 is a view looking up from the bottom of the vessel, showing the ballast positioned for sailing up wind.

FIG. 2 shows the location of the center of mass of ballast 12 with respect to the centerline of the vessel 10 as it is rotated about shaft 14. In this view, ballast 12 is positioned for sailing upwind on port tack. Righting moment is increased by both the movement of the center of mass of ballast 12 away from vessel 10 centerline and by the downward angle of attack of support beam 13.

Figure 3:
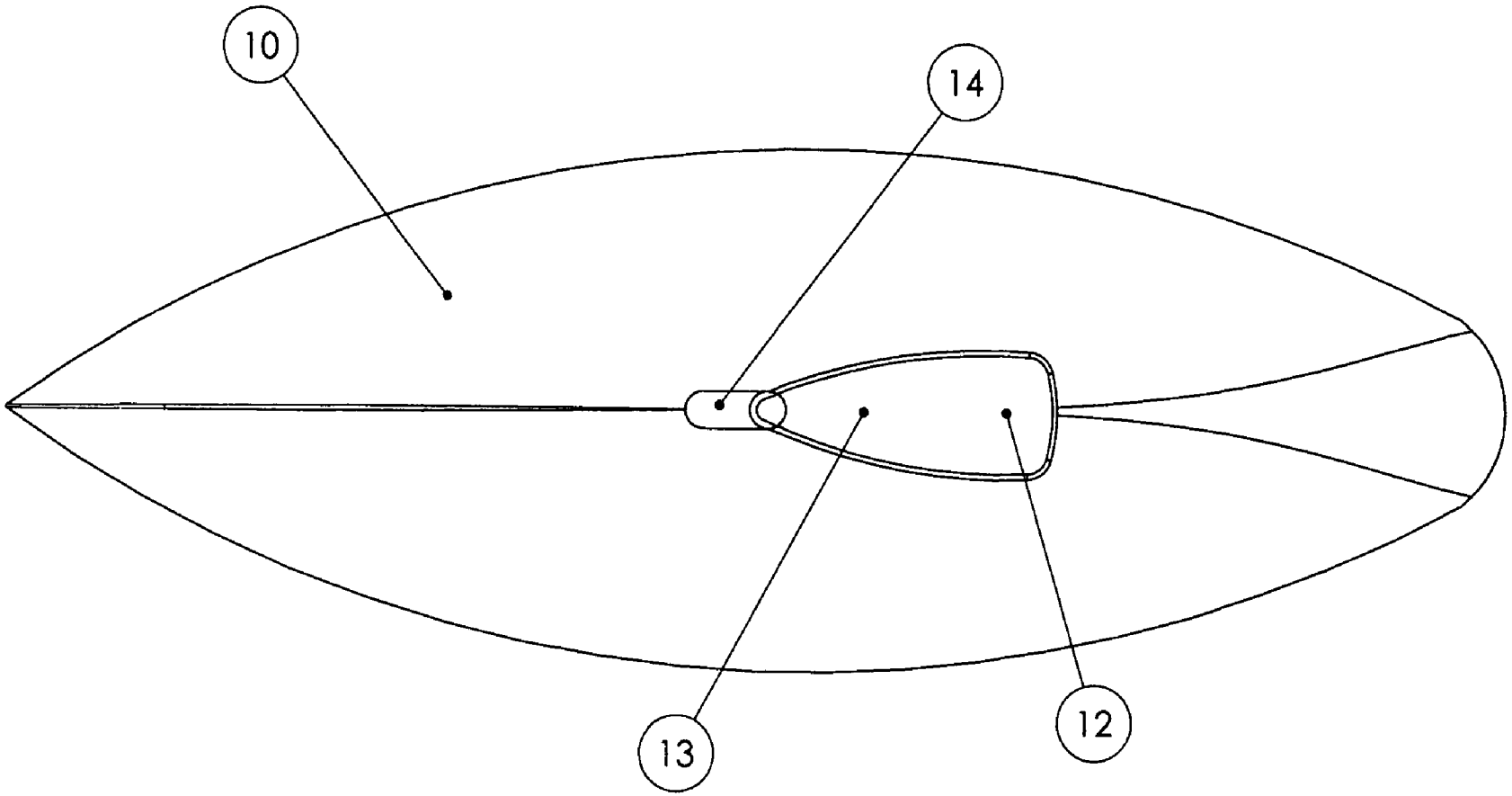
FIG. 3 is a view looking up from the bottom of the vessel of the ballast positioned for sailing downwind.

FIG. 3 shows the vessel moving in the direction of the wind. For this running condition, the center of mass of the ballast is in line with the keel (not rotated). In the case depicted in FIG. 3, the center of mass is aft of the center of buoyancy of vessel, which helps counter the moment generated by the sails which would act to drive the bow of the vessel 10 down.

Figure 4:
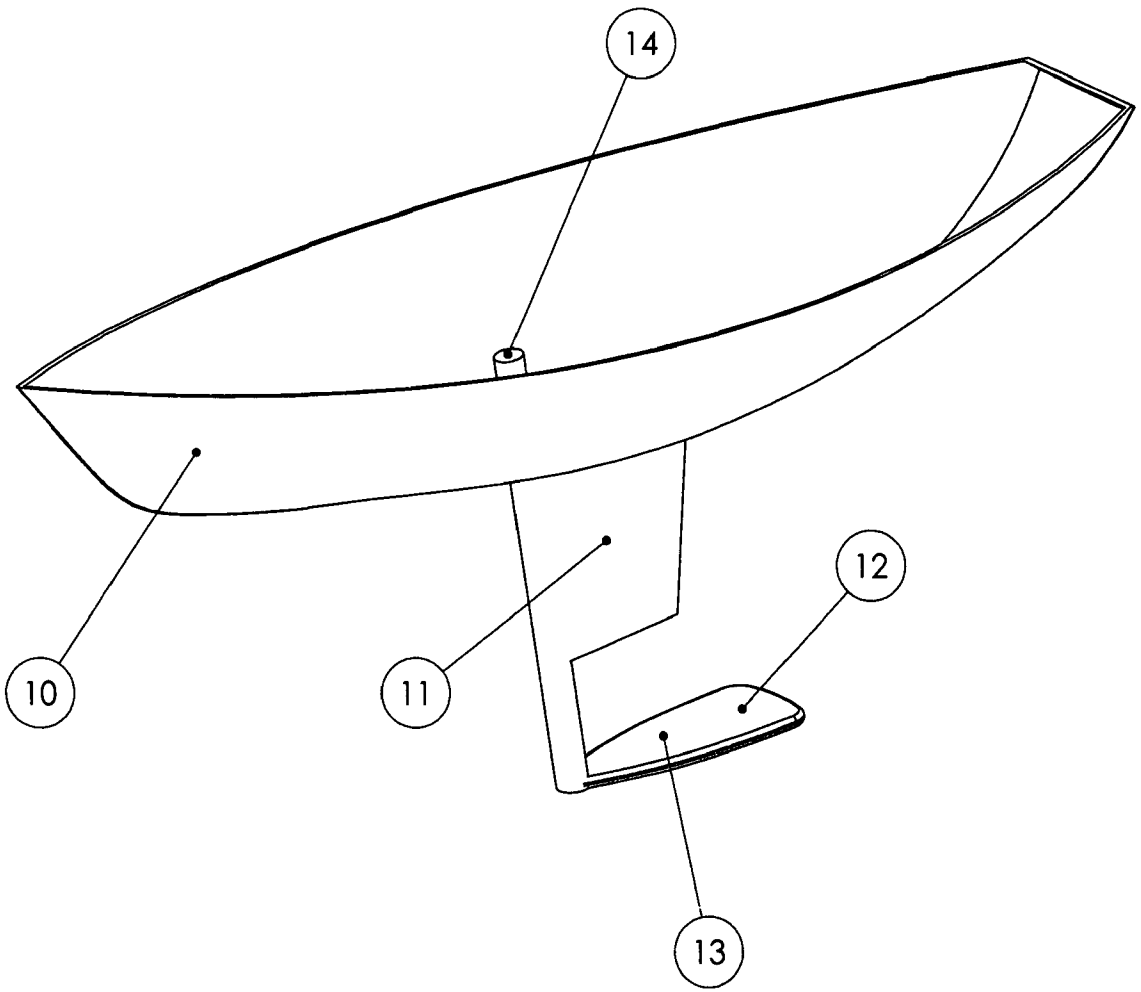
FIG. 4 shows an embodiment which includes axial extension of the ballast to increase righting moment. Ballast can be extended by moving the shaft axially, still allowing the shaft to rotate.

FIG. 4 depicts an embodiment where the support beam 13 is mounted to the pivot shaft 14 on one end, and which supports the ballast 12 cantilevered from the shaft. The shaft 14 can be moved axially, moving the ballast 12 further from the center of buoyancy of the ship 10 which in turn increases its righting moment When shaft 14 is rotated, support beam 13 and ballast 12 sweep out a plane that is not horizontal and parallel to the bottom of the boat. The center of mass of the ballast actually moves forward and down with respect to its normal centered position. This movement adds additional length to the moment arm between the shaft and the center of buoyancy of the vessel, increasing righting moment. Further, the movement of the ballast out of the shadow of the keel and into the water flowing adjacent to the keel adds a hydrodynamic force which is additive to the weight to further increase righting moment. These additional forces allow the vessel to be designed with a lower ballast weight than would otherwise be necessary, the lessened weight decreases displacement and drag and further increases performance. It is obvious to one skilled in the art that it is also possible to mount the ballast to the shaft such that it sweeps out a plane that is horizontal (parallel to the bottom of the hull).

Figure 5:
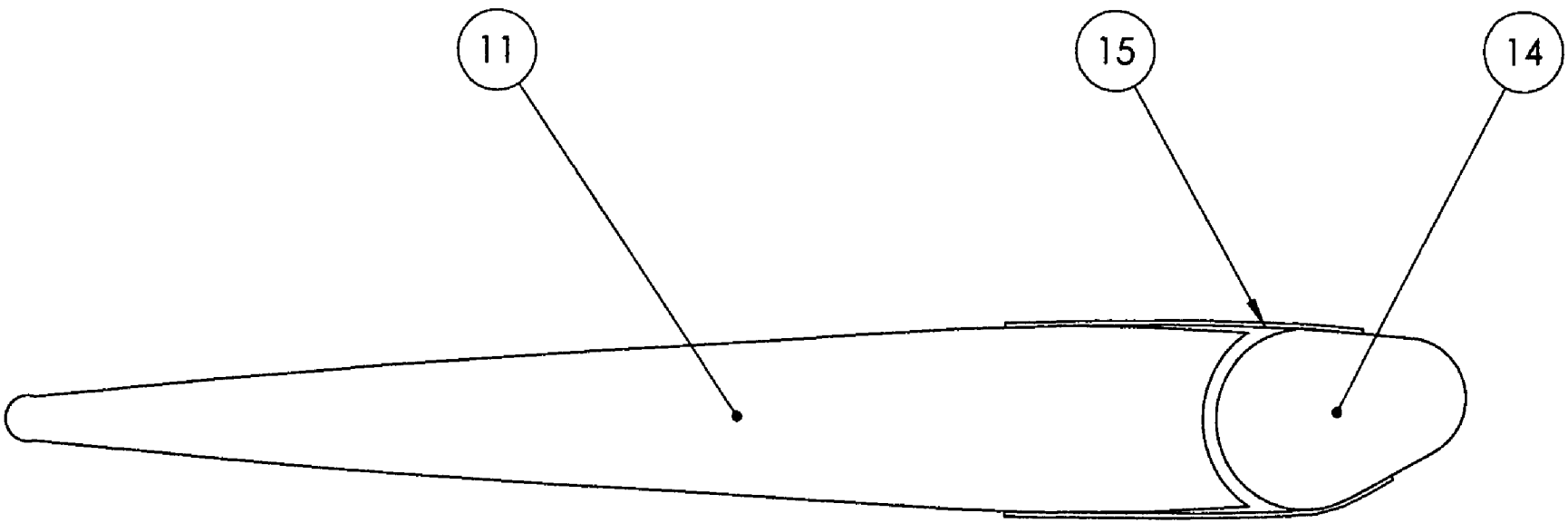
FIG. 5 is a section view of the keel showing the shaft located in front of the keel. The leading edge of the keel changes as the shaft rotates.

FIG 5 depicts an embodiment where the pivot shaft 14 is mounted on the leading edge of the keel 11, and the shaft where exposed to the water has a hydrodynamically efficient shape. The shaft is mounted at the upper and lower end of the keel, allowing it to pivot Pivoting the shaft configured as described modifies the hydrodynamic efficiency of the keel.

Thus the invention allows for the design of a sailing yacht which enhances the effectiveness of external ballast, which can then be designed for minimum weight and maximum performance. Further, the invention eliminates many of the drawbacks of prior inventions, including replacing the complex seals required by swing keels by simple rotary seals, eliminating much of the structure, cost and complexity and improving the safety of vessel as compared to a swing keel design. No failure of any element of this design would risk the integrity of the vessel. The embodiments described here do so to illustrate the concepts claimed in the invention and do not purport to be the only embodiments possible. Rather, one skilled in the art can envision a variety of additional ways to implement means to rotate and axially position a fixed ballast as to maximize performance of a sailing yacht.

We claim:

1. A sailing yacht comprising:

a hull with a fixed fin keel; said keel having a leading edge and a trailing edge;

a shaft rotate-ably mounted on said leading edge of said fin keel, said shaft having an upper and a lower end, said mounting of shaft to include bearing support on said upper and said lower ends of said shaft, said shaft having a central portion between said mountings exposed to the water forward of said leading edge of said keel;

a beam having a first end and a second end, said first end of said beam rigidly fixed to said lower end of said shaft;

a ballast weight mounted to said second end of said beam;

means connecting to upper end of said shaft for rotating said shaft such that when the said shaft is rotated, said weight is moved in an arc about said shaft.

2. A sailing yacht as recited in claim 1 wherein said mounting of shaft, includes means for axially moving said rotate-ably mounted shaft in a vertical direction, allowing the ballast weight to be raised and lowered.

3. A sailing yacht as recited in claim 1 wherein the weight is shaped to have a low coefficient of hydrodynamic drag and has a center of mass.

4. A sailing yacht as recited in claim 1 wherein the exposed central portion of the shaft has a non-circular cross section.

5. A sailing yacht as described in claim 4 wherein the central portion of the shaft is designed to blend with the leading edge of the keel and minimize hydrodynamic drag when in a non-rotated position.

6. A sailing yacht as described in claim 4 wherein rotating the shaft modifies the hydrodynamic efficiency of the keel.

7. A sailing yacht as recited in claim 3 wherein the center of mass moves forward and down with respect to the vessel.

8. A sailing yacht as recited in claim 3 wherein the weight and beam when rotated out of the neutral centered position act as a fin adding dynamic force which acts to increase righting moment.

9. A sailing yacht as described in claim 1 further comprising means to secure the shaft and weight in any desired rotated position.

* * * * *